US006427926B1

(12) United States Patent
Lai

(10) Patent No.: US 6,427,926 B1
(45) Date of Patent: Aug. 6, 2002

(54) TOY VEHICLE TRACK

(75) Inventor: Choi Yau Lai, Hong Kong (HK)

(73) Assignee: Fanhill Limited (HK)

( * ) Notice: Subject to any disclaimer, the term of this patent is extended or adjusted under 35 U.S.C. 154(b) by 0 days.

(21) Appl. No.: 09/760,570

(22) Filed: Jan. 15, 2001

(51) Int. Cl.[7] ..... E01B 23/00
(52) U.S. Cl. ..... 238/10 R; 104/53
(58) Field of Search ..... 104/53, DIG. 1; 105/1.5; 238/10 A, 10 B, 10 E, 10 F, 10 R; 273/153 R, 157 R

(56) References Cited

U.S. PATENT DOCUMENTS 3,352,054 A * 11/1967 Glass et al. ..... 238/10 A
3,402,503 A * 9/1968 Glass et al. ..... 238/10 A
3,414,194 A * 12/1968 Seitzinger et al. ..... 238/10 A
3,579,904 A * 5/1971 Genin ..... 238/10 A
4,346,889 A * 8/1982 Barlow et al. ..... 273/153 R
4,469,331 A * 9/1984 Rinker ..... 273/157 R
4,504,243 A * 3/1985 Barlow et al. ..... 446/447
4,685,884 A * 8/1987 Rohan ..... 273/157 R
4,941,611 A * 7/1990 Arsenault ..... 238/10 A
4,953,786 A * 9/1990 Arsenault ..... 238/10 B
4,990,117 A * 2/1991 Yonezawa ..... 446/136
6,033,746 A * 3/2000 Morris ..... 428/33

* cited by examiner

*Primary Examiner*—S. Joseph Morano
*Assistant Examiner*—Lars A. Olson
(74) *Attorney, Agent, or Firm*—Jackson Walker L.L.P.

(57) ABSTRACT

A set of regular pieces are used to form a continuous toy track when joined together. The pieces can stack, or be joined together end to end and side to side using jig-saw connections formed on their sides. Ramp pieces are included in the set, and fit to the regular pieces, to enable the track to be formed in a 3-dimensional manner.

7 Claims, 5 Drawing Sheets

TOY VEHICLE TRACK

BACKGROUND OF THE INVENTION

1. Field of the Invention

The invention relates to toy vehicle tracks.

2. Description of Prior Art

It is well known to provide a track for toy vehicles such as care, locomotives, railway trucks and the like, formed of a number of pieces that fit together to form a continuous track. The pieces may be quite different so that straight pieces, curved pieces, bridge pieces, tunnel pieces and so forth, can be joined together end to end to make up different configurations of a track for the car or train. Often the ends of the pieces have integrally formed configurations so that adjacent pieces are joined and held or kept together by "jig-saw" shaped connections integrally formed on the ends of the pieces that releasably inter-engage.

A particular set of pieces that fall within the ambit of this prior art comprise a number of square pieces that each have an upper surface formed with one or more tracks for a vehicle and that are joined together in use by jig-saw type connections on each of their four sides.

A continuous circuitous track is formed for a vehicle, typically a toy car with a central downwardly protruding steering post that enters into the track. Such a set of pieces when joined together form a track in only two-dimensions which is somewhat restrictive.

SUMMARY OF THE INVENTION

It is an object of the invention to overcome or to at least reduce this problem.

According to the invention there is provided a set of regular pieces arranged to be brought together end to end to form a continuous toy track that extends across top surfaces of the pieces, in which each regular piece has the same depth and is rectangular in overall plan and formed with jig-saw longitudinally disposed connections at each end for co-operating With and joining to an adjacent piece end to end, each piece has an upper formation to engage with a lower formation of another piece such when the two pieces are stacked on top of another the upper and lower formations provide a locating key between the stacked pieces, in which the set includes two or more ramp pieces each formed with complimentary dimensions to the regular the pieces and jig-saw connections, the ramp pieces each providing a track section adjacent a lower end of the ramp to line up in elevation with a regular piece joined at the lower end and providing a track section adjacent an upper end of the ramp to line up in elevation with a multiple of regular pieces stacked adjacent the upper end so that the track rises up as it passes from the single piece to a top of the multiple pieces.

All the pieces may be generally square in overall plan, and each piece has jig-saw connections laterally disposed at each side to join adjacent pieces side by side.

The upper end of the ramp piece is preferably arranged to line up in elevation with two stacked pieces.

A lower surface of each ramp piece preferably has lower formations for keying to upper formations of the regular pieces.

The upper and lower formations may be provided at upper and lower peripheries of the pieces.

Separate removable connectors may be provided for holding adjacent pieces together and insertion apertures in each adjacent piece into which pins of the connector can be pushed and releasably retained.

BRIEF DESCRIPTION OF THE DRAWINGS

A set of pieces that can be brought together to form a continuous track for a toy car including ramp pieces according to the invention will now be described by way of example with reference to the accompany drawings in which.

DESCRIPTION OF THE PREFERRED EMBODIMENTS

Figure 1:
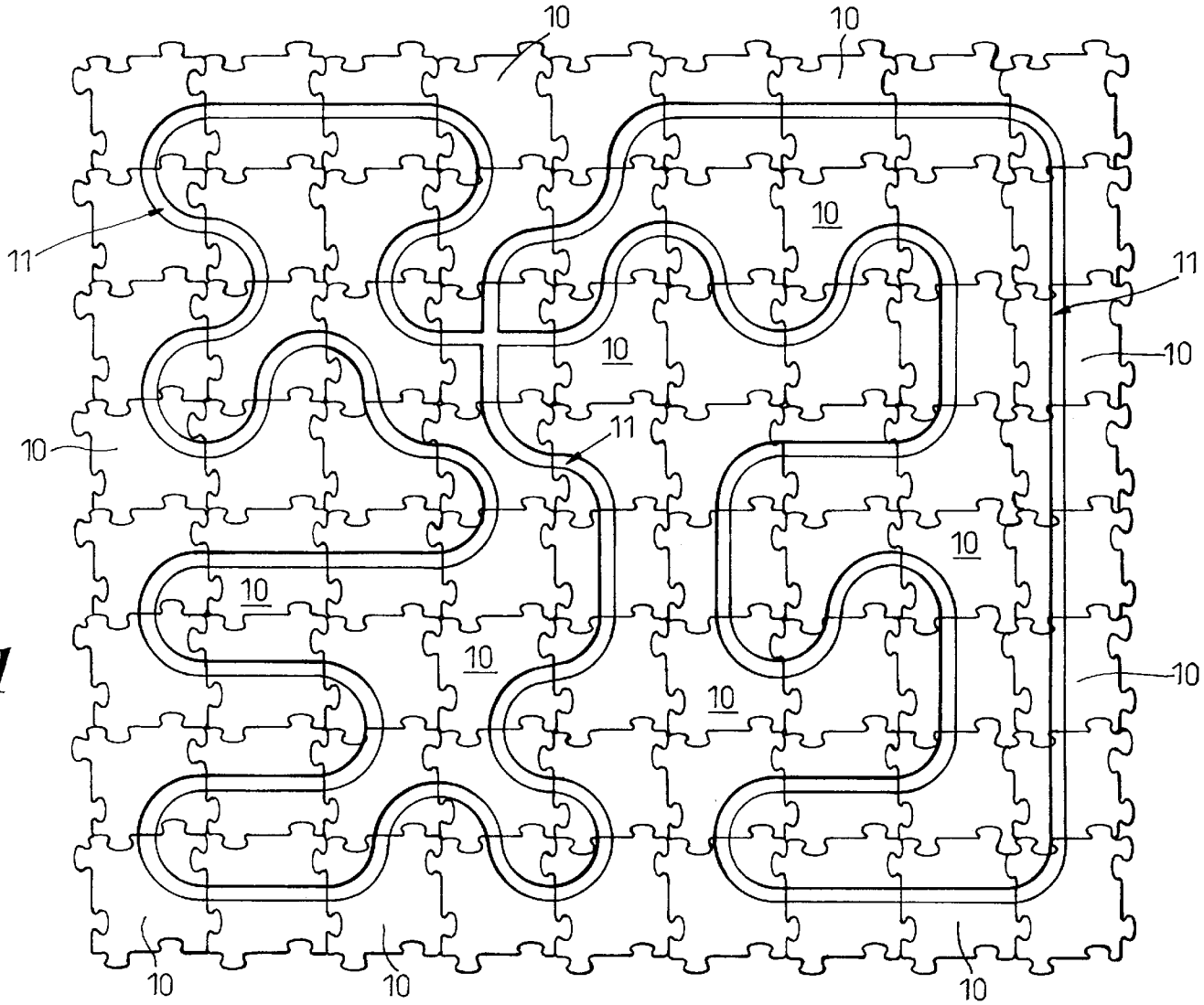
FIG. 1 is a plan view of a continuous track made up of pieces according to the prior art.

Referring to the drawings, in FIG. 1 a set of like square pieces 10 are joined together to form a continuous circuitous track 11 as shown. Each piece has the same depth and a curved or straight track section formed in its upper surface. The pieces each have formations in their four sides that come together and mate, in the manner of a jig-saw, to hold the pieces adjacent one another end-to-end and side-to-side, as shown. As such, the set provides a two-dimensional guide track for a suitable toy car having a central downwardly protruding guide.

Figure 2:
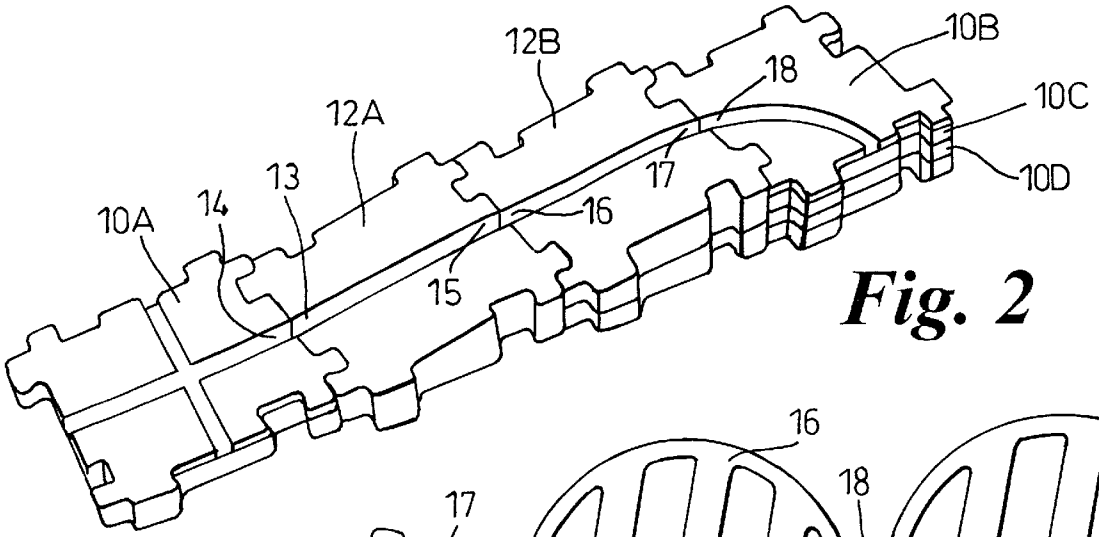
FIG. 2 is an isometric view of a part of a track including two ramp pieces.

In order to form a 3-dimensional track, a set according to the invention includes two ramp pieces 12A and 12B as shown in FIG. 2. One ramp piece 12A has a track section 13 at its lower end that lines up in elevation with a track section 14 of a regular piece 10A, (The term 'regular piece' is used simply to denote a generally planar piece, albeit a novel piece, being a non-ramped piece of the set). An upper end track section 15 lines up in elevation with a track section 16 in a lower end of the ramp piece 12B. A track section 17 adjacent an upper end of the ramp piece 12B lines up in elevation with a track section 18 in a regular piece 10B. The piece 10B is stacked on top of two regular pieces 10C and 10D. Thus, the track extending from the piece 10A to the piece 10B raises up by the equivalent of the depth of two regular pieces of the set.

Figure 3:
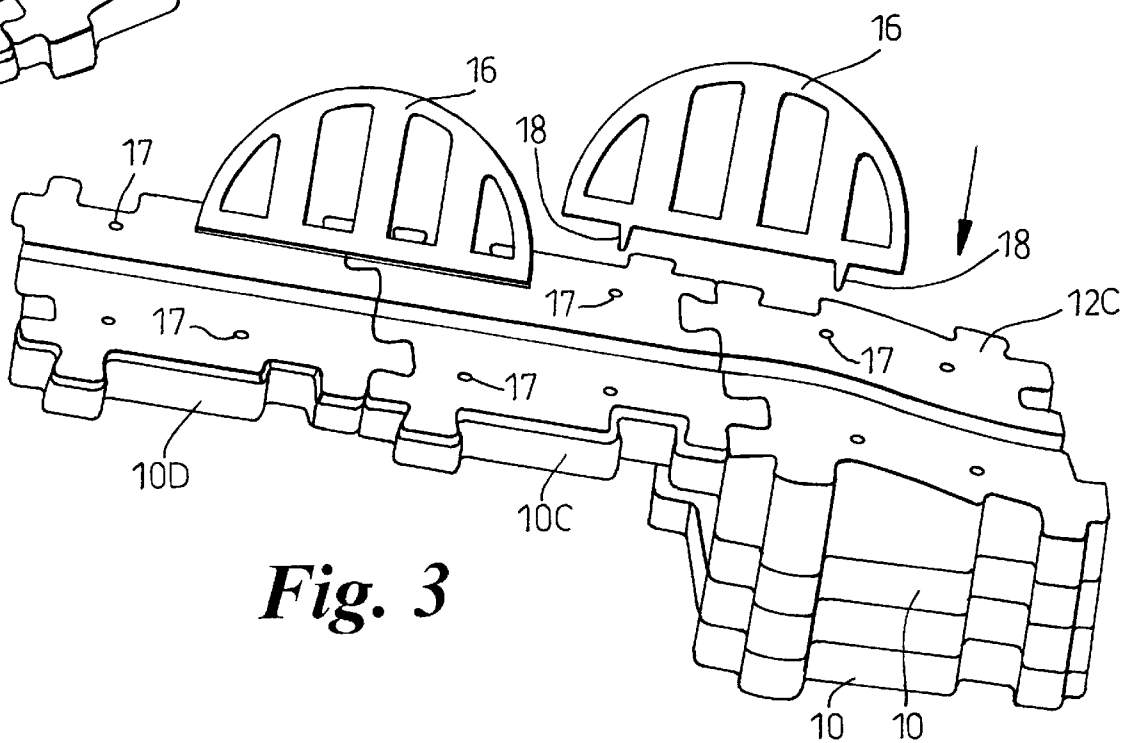
FIG. 3 is an isometric view of another part of a track including a ramp piece.

In FIG. 3, a ramp piece 12C is shown mounted on a stack of three regular pieces and connected to two other regular pieces 10C and 10D that form part of a suspended bridge. The pieces 12C, and 1OC and 10D are held together in use by respective connectors 16. Each piece has suitably positioned apertures 17 for receiving and frictionally restraining integrally formed pairs of pins 18 on the bottom of the connectors 16.

Figure 4:
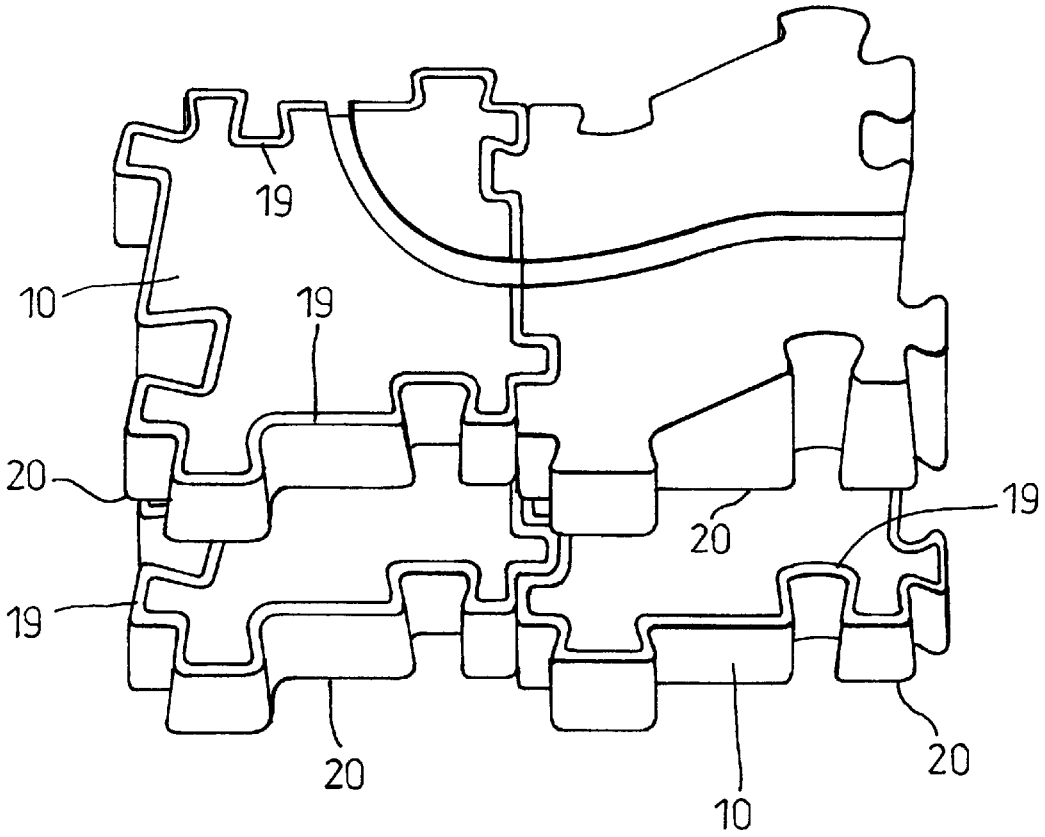
FIG. 4 shows two regular pieces of the set one above another.

In FIG. 4, it can be seen that each piece 10 is formed with an upper peripheral ledge formation 19 and a lower peripheral lip formation 20 that fits to the respective formation 19. When the pieces are stacked on top of one another, the peripheral formations key the adjacent two pieces together to hold the stacked pieces together in line to provide physically robust stacking of the pieces.

In embodiments of the invention, the ramp pieces 12 enable stable 3-dimensional continuous tracks to be made up for toy vehicles, adding to the variety and interest when using toy tracks of this kind.

It will be appreciated that the regular pieces and the ramp pieces may be arranged with only end jig-saw connections, where the pieces are arranged to be joined only end to end to make up a 3-dimensional track. As such the pieces may be conveniently rectangular, rather than square, if desired. Also, the upper and lower formations for keying stacked pieces together may take many other forms, such as suitably positioned pins and apertures that fit together to maintain required stacked alignment and stability.

The described ramp pieces 12 rise up the equivalent of one depth of a regular piece in each case. It is possible for the ramp pieces to rise up the depth of two or more regular pieces; this is especially the case if the pieces are rectangular and connectable lengthwise end to end.

The described pieces are preferably made of plastics material or wood block.

Figure 5:
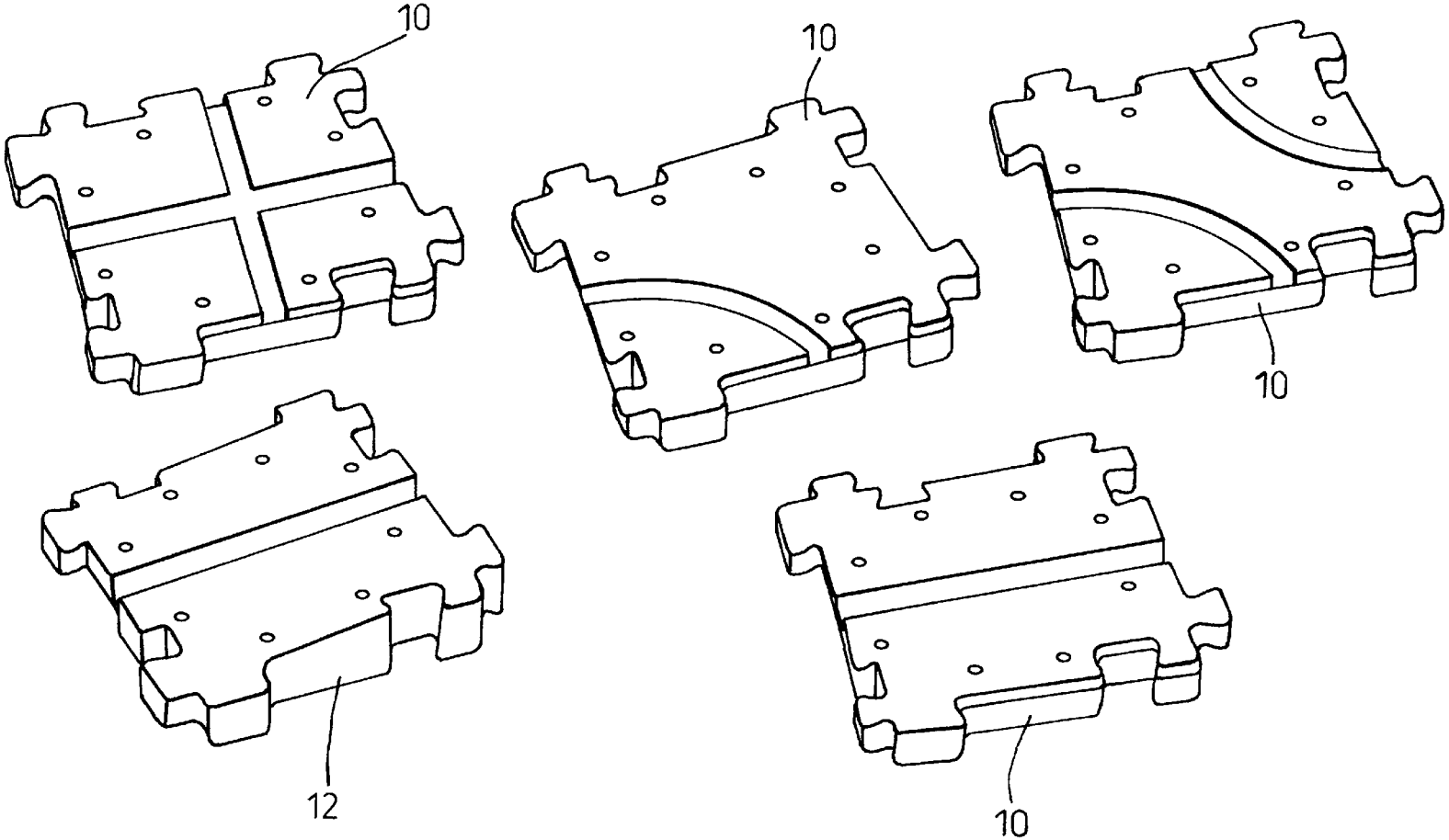
FIG. 5 is an isometric view of four different regular pieces and one ramp piece.
Figure 6:
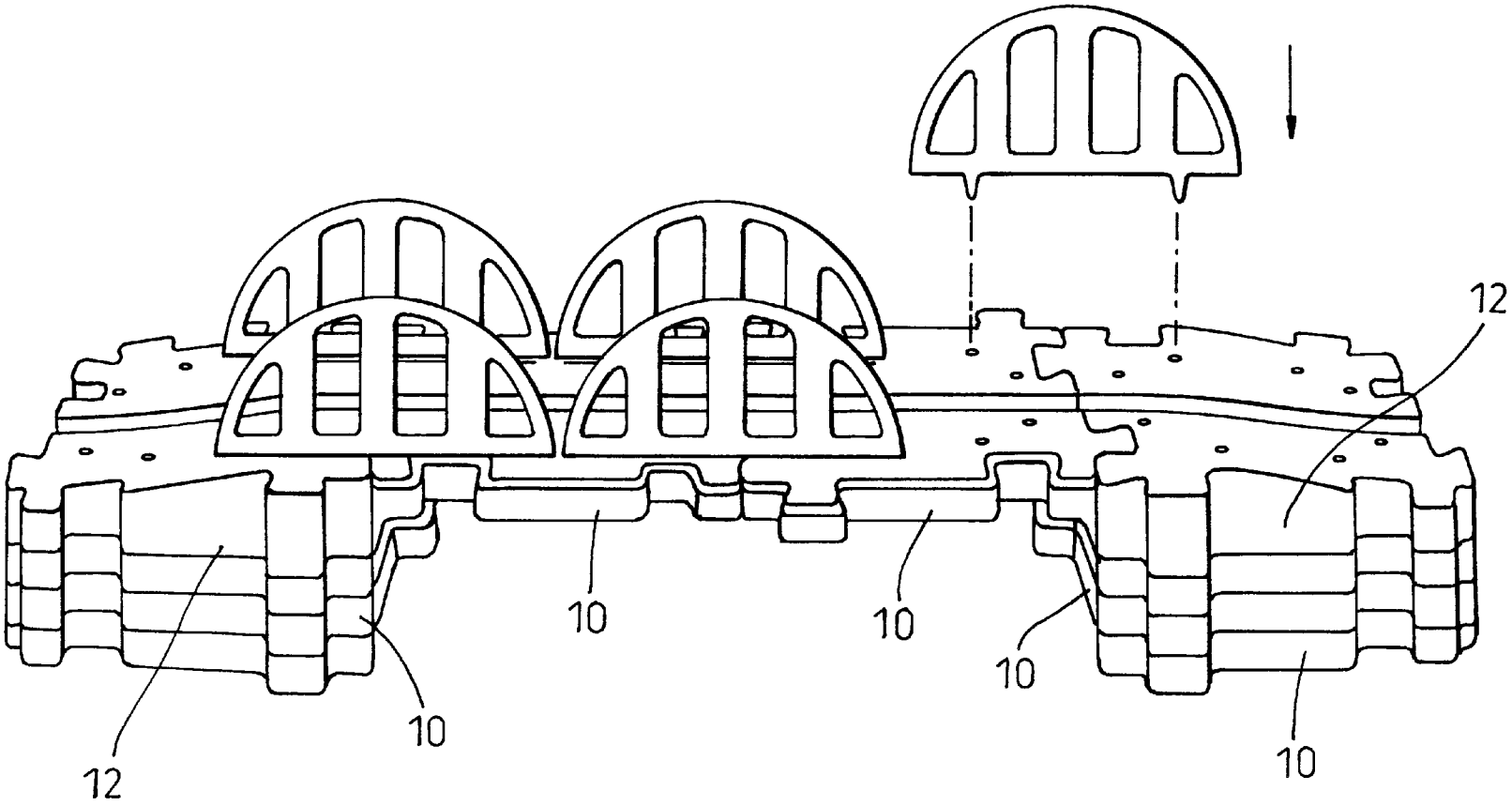
FIG. 6 is an isometric view of a bridge made up with a number of regular pieces and two ramp pieces.

In FIG. 5, the four different forms of regular pieces 10 differ in the configuration of track provided by each piece. A normal set of pieces includes a 'mixture' of regular pieces allowing a continuous track as shown in the prior art (FIG. 1) to be made up. By providing ramp pieces 12 the continuous track may be 3-dimensional and bridges, for example (FIG. 6), made up using a combination of regular pieces 10 and the ramp pieces 12.

I claim:

1. A set of toy track pieces arranged to be brought together end to end to form a continuous toy track that extends across top surfaces of the pieces, in which each track piece has the same depth and is rectangular in overall plan and formed with jig-saw longitudinally disposed connections at each end for cooperating with and joining to an adjacent piece end to end, each piece having an upper formation to engage with a lower formation of another piece such that when the two pieces are stacked on top of one another the upper and lower formations provide a locating key between the stacked pieces, in which the set includes two or more ramp pieces each formed with complimentary dimensions to the track pieces and jig-saw connections, the ramp pieces each providing a track section adjacent a lower end of the ramp to line up in elevation with a single track piece joined at the lower end and providing a track section adjacent an upper end of the ramp to line up in elevation with a multiple of track pieces stacked adjacent the upper end so that the track rises up as it passes from the single piece to a top of the multiple pieces.

2. A set of pieces according to claim 1, in which all the pieces are generally square in overall plan.

3. A set of pieces according to claim 1, in which each piece has jig-saw connections laterally disposed at each side to join adjacent pieces side by side.

4. A set of pieces according to claim 1, in which the upper end of the ramp piece is arranged to line up in elevation with two stacked pieces.

5. A set of pieces according to claim 1, in which a lower surface of each ramp piece has lower formations for keying to upper formations of the track pieces.

6. A set pieces according to claim 1, in which the upper and lower formations are provided at upper and lower peripheries of the pieces.

7. A set pieces according to claim 1, including separate removable connectors for holding adjacent pieces together and insertion apertures in each adjacent piece into which pins of the connector can be pushed and releasably retained.

* * * * *